United States Patent [19]

Harpold

[11] 4,351,238

[45] Sep. 28, 1982

[54] METHOD FOR SCREEN PRINTING

[76] Inventor: Charles W. Harpold, 274 Greenbrier Dr., SE., Grand Rapids, Mich. 49506

[21] Appl. No.: 190,503

[22] Filed: Sep. 25, 1980

[51] Int. Cl.[3] ..... B41C 1/14

[52] U.S. Cl. ..... 101/128.4; 101/123; 101/128.21

[58] Field of Search ..... 101/127, 128, 128.4, 101/129, 128.21, 123; 83/862, 863, 864, 865, 51; 434/82, 87

[56] References Cited

PUBLICATIONS

"Loose Paper Knife Cut Stencil Screen", *57 How-To--Do-It Charts* by Harry L. Hieft, p. 38.

"The Film Stencil Method", *Screen Printing,* by J. I. Biegeleisen, Chapter Seven, pp. 55–57.

"Making Stencils", *Know How* by Osborne, Comics Section Washington Post, Oct. 5, 1975.

*Primary Examiner*—Edgar S. Burr

*Assistant Examiner*—Moshe I. Cohen

*Attorney, Agent, or Firm*—Price, Heneveld, Huizenga and Cooper

[57] ABSTRACT

The specification discloses a method for screen printing comprising providing a sheet of masking sized to cover a porous printing screen, with pressure sensitive adhesive on one side of the masking and a protective cover sheet thereover. The masking is positioned, cover side up on a work surface, and the desired pattern is scribed on the cover sheet with a pointed instrument, so as to form an indentation in the masking which is visible from the front side thereof. The masking is then turned over on the work surface, front side up, and is cut along the indentation. The cover sheet is peeled from the back side of the masking, thereby removing the enclosed, cut areas from the masking to form a mask or stencil corresponding to the desired pattern. The stencil is then pressed onto the lower side of the printing screen to attach the same to the screen.

17 Claims, 7 Drawing Figures

METHOD FOR SCREEN PRINTING

CROSS REFERENCE TO RELATED APPLICATIONS

The present application is related to my copending United States patent application Ser. No. 190,504, filed Sept. 25, 1980, now abandoned, and entitled SCREEN PRINTER AND KIT, which is hereby incorporated by reference.

BACKGROUND OF THE INVENTION

The present invention relates to screen printing, and in particular to a method for forming a pattern on a printing screen.

Screen printing has become very popular for printing names, slogans, designs, insignias, and the like, on various articles of clothing, such as T-shirts, etc. Heretofore, even the most basic processes for forming the printing screen, such as photosensitive screens, the Tousche process, tracing film, and the like, are rather expensive, tedious, and require professional assistance to achieve neat, attractive patterns. Further, prior screen preparation methods are extremely difficult and messy to clean, such that a complete new screen is required for each pattern which the user desires to print.

SUMMARY OF THE INVENTION

The present invention is a method for screen printing which is sufficiently uncomplicated and inexpensive to enable novice printers, and other unskilled personnel, to reliably print clean, neat, attractive designs. The method comprises providing a sheet of masking, constructed of an indentable material and sized to cover the porous printing screen. The masking is positioned, cover side up on a work surface, and scribed with a selected pattern on the cover sheet with a pointed instrument so as to form a corresponding indentation in the masking which is visible from the front side thereof. The masking is then positioned front side up on the work surface, and is cut along the indentation line. The enclosed areas of the pattern are removed from the masking, so as to form an apertured stencil corresponding to the desired pattern which is attached to one side of the screen. During printing, ink is forced through the stencil apertures by a squeegee or roller to print the pattern onto an article. Preferably, the back side of the masking includes an adhesive coating with a protective cover sheet thereover, so that the stencil is adhered to the screen. When the pattern includes alphanumeric symbols, the symbols are easily laid out in a readable, left-to-right, right-side-up sequence on the masking cover sheet.

The principal objects of the present invention are to provide an uncomplicated, inexpensive method for screen printing, which can be practiced by unskilled personnel, and achieve attractive printed patterns. The method produces a screen which can be easily cleaned and changed, to facilitate printing different designs, as well as multicolor patterns.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
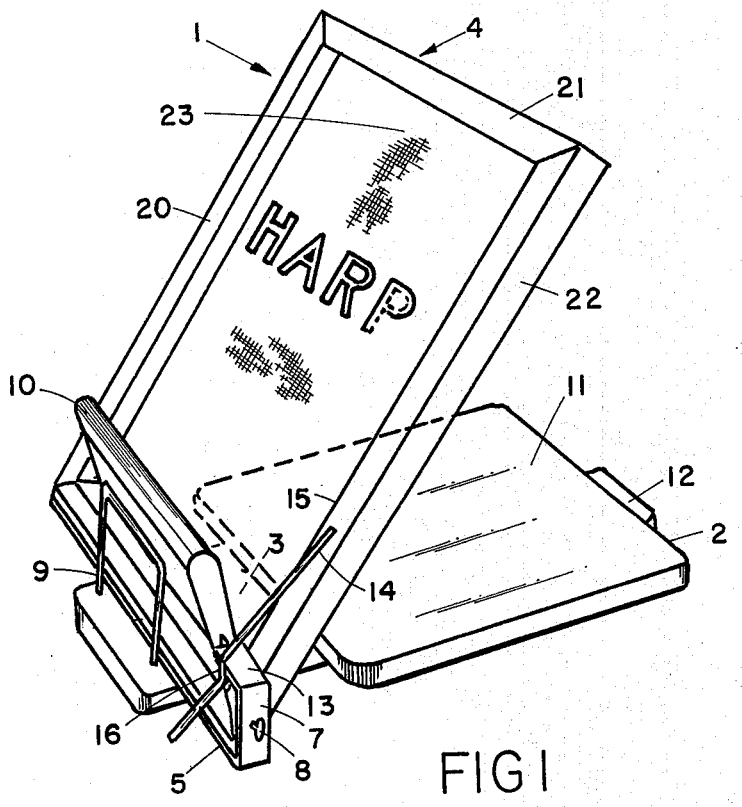
FIG. 1 is a perspective view of a screen printer used in the practice of a method embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 generally designates a screen printer adapted for practicing a method embodying the present invention. Screen printer 1 is identical to the mechanism disclosed in my above referenced, copending United States patent application, entitled SCREEN PRINTER AND KIT. The illustrated screen printer 1 comprises a platen 2 mounted on a base 3, and a printing screen 4 pivotally attached to platen base 3 by a U-shaped bracket 5. The rearward end of printing screen 4 is received between the upstanding arm 7 of bracket 5, and inwardly projecting, laterally aligned pins 8 protrude into the printing screen frame to rotatably interconnect the rearward screen end with the platen. An inverted U-shaped standard 9 is mounted on platen base 3, and extends upwardly above the rear frame segment of the printing screen to support a squeegee 10 in an upright orientation when the screen is raised to the storage position shown in FIG. 1. The illustrated platen 2 has a smooth, flat upper surface 11, and is particularly shaped for printing T-shirts thereon. However, the apparatus and method disclosed herein can be practiced to print on paper, metal, plastic, glass and fabrics other than T-shirts. The forward end of base 3 includes a projection 12 over which the neck of the T-shirt is positioned. Mounting bracket 5 includes an inwardly turned end 13 on the left-hand end, which is shaped for selective abutment with a latch arm 14. The forward end 15 of latch arm 14 is mounted in an aperture in the upper surface of the right-hand printing frame side rail, and includes a laterally offset catch portion 16 which engages bracket end 13 to retain printing screen 4 in the raised, storage position illustrated in FIG. 1.

Figure 2:
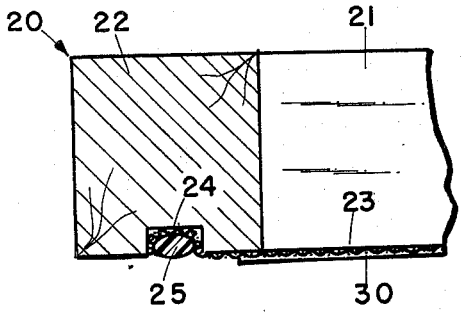
FIG. 2 is an enlarged, fragmentary vertical cross-sectional view of a screen portion of the printer.

Printing screen 4 is of a conventional construction, and includes a frame 20 having interconnecting end and side segments 21 and 22 respectively. A panel of porous screen or mesh 23 (FIG. 2) such as silk or polyester, is stretched taut along the lower side of frame 20, and is attached thereto along its marginal edge in a channel 24 by a resilient bead 25.

Figure 6:
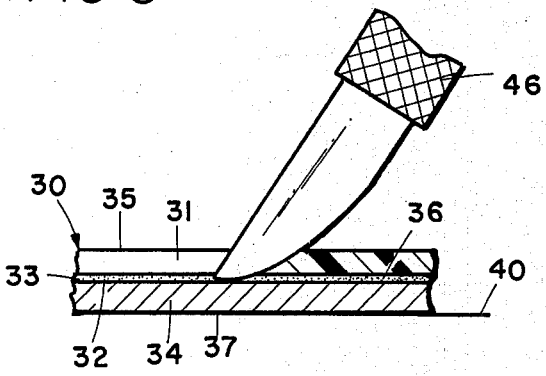
FIG. 6 is a schematic, cross-sectional illustration of a masking cutting step.

A sheet of masking 30 is provided from which a stencil is cut and attached to one side of printing screen 4 for printing a selected pattern onto an article positioned on platen 2. With reference to FIG. 6, masking 30 comprises a thin, substantially imperforate, indentable film or sheet 31, constructed of clear or metalized plastic, such as polyester or that known in the trade as Mylar. Sheet 31 preferably includes a layer or coating of adhesive 32 on the back side of sheet 31, and a protective cover sheet 34 overlies and is adhered to adhesive coating 32. Cover sheet 34 may be constructed of any suitable material, such as impregnated paper, or the like, and preferably has a slick, non-bonding interior surface 36 which can be readily separated from adhesive 32, and an exterior surface 37 capable of being marked upon by a pencil, a pen, or other writing instrument. Masking sheet 31 also includes a front side 35 which is normally disposed adjacent to the article to be printed.

In the method contemplated by the present invention, a sheet of masking 30 is provided, which is sufficiently large to cover printing screen 4. The marginal edges of the masking sheet 30 should overlie that portion of the screen disposed between the interior edge of the frame and channel 24. If the sheet of masking is too large, it should be cut to this size.

The sized sheet of masking 30 is positioned front side 35 down on a smooth, flat working surface, such as that schematically illustrated in FIG. 6 and noted by the reference numeral 40. Working surface 40 is preferably relatively soft or elastic, such as that constructed of wood or the like, for purposes described below. In the method illustrated in FIG. 3, the pattern 41 to be printed onto the article is laid out on cover sheet 34, so that it is evenly spaced and arranged in the precise manner as the user desires the pattern to be printed onto the article. This can be done by light pencil markings on cover sheet 34 or other similar means. When the pattern includes alphanumeric symbols, such as those noted by the reference numeral 42, the symbols are laid out on cover sheet 34 in a readable, left-to-right, right-side-up sequence or fashion. All design portions of the pattern, such as insignias, etc, which are to be arranged with respect to each other, should be laid out on cover sheet 34 in precisely the same manner as the user desires them to appear on the printed article.

Figure 4:
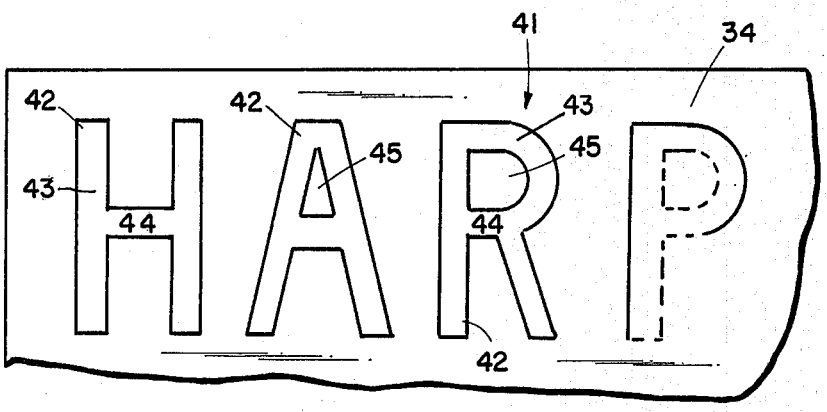
FIG. 4 is a partially schematic, fragmentary plan view of a section of masking, cover side up, on which alphanumeric symbols have been laid out.
Figure 5:
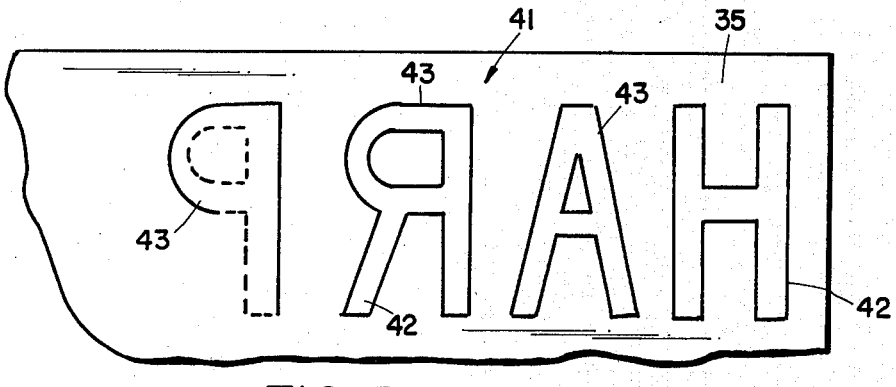
FIG. 5 is a partially schematic, fragmentary, plan view of the masking shown in FIG. 3, with the cover side down.

Once the pattern has been laid out, the user scribes the pattern on cover sheet 34 with a pointed instrument, so as to form a corresponding indentation 43 in masking 30 which is visible from the front side 35 thereof, as shown in FIG. 5. The "P" in FIGS. 1 and 4–5 has been only partially formed for illustration purposes, wherein the broken lines indicate the layed out portion of the letter which has not yet been scribed. Scribing may be performed with a sharpened pencil, ball point pen, or other similar marking instrument, wherein sufficient pressure is maintained on the tip to create the requisite indentation. In this manner, the user simply traces over the lines laid out on cover sheet 32. It is to be understood that the present method also contemplates drawing or scribing a pattern directly onto cover sheet 34 without first laying out the various portions of the design. However, this practice is advisable only after the user has aquired some skill in screen designing, or wishes to create a very simple pattern. The relatively soft work surface 40 aids in the formation of a crease or indentation 43 which is well defined and clear from the front surface 35 of the masking. The use of a metalized plastic masking also facilitates this objective, and is particularly adapted for single color designs. Clear or transparent masking material is preferred for use with multicolor patterns, wherein at least two screens are required to print one complete design. In this embodiment, the various screens can be visually aligned or adjusted to insure proper registry. As noted in FIG. 4, the pattern scribed on cover sheet 34 appears on the front side 35 of masking 30, as the mirror image of the same. Pattern 41 includes at least one closed area 44, which is completely encircled by the indentation lines 43. In the illustrated alphanumeric symbols 42, the closed areas comprise the outline of the letter, and some of the letters, such as the "A", "R", and "P", have double enclosed center areas 45.

The scribed masking is then picked up and turned over on work surface 40, with the front side 35 facing upwardly, as shown in FIG. 6. Masking 30 is cut along each of the indentation lines 43, by means such as manually slicing the same with a craft knife 46, as schematically illustrated in FIG. 6. Knife 46 penetrates through adhesive coating 32, but preferably does not cut through cover sheet 34. However, it is to be understood that the present invention may be practiced as contemplated herein, even if the knife cuts through cover sheet 34.

Figure 7:
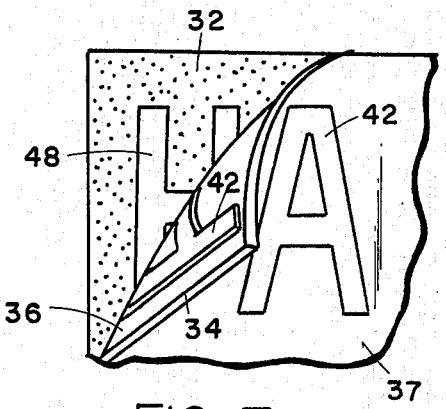
FIG. 7 is a partially schematic, plan view of the masking, showing the cover sheet being removed therefrom.

The closed areas 44 of the pattern are then removed from the masking 30. Preferably, this is achieved by peeling cover sheet 34 from the cut masking sheet 30, as illustrated in FIG. 7, or otherwise separating the same from the masking sheet 31. The closed areas 44 and double enclosed areas 45, such as the center of the "A", "R", and "P", remain adhered to cover sheet 34 and are removed from masking sheet 31 when the cover sheet is peeled off. Sheet 31 is preferably turned over on work surface 40 with front side 35 down to peel the cover sheet from the adhesive back side of the masking sheet, as shown in FIG. 7, thereby forming a mask or stencil with apertures or openings 48 arranged in the desired pattern. If the symbols include any cut out center areas 45, such as the triangular center of the letter "A", the present invention contemplates several different means for positioning and attaching areas 45 to the screen. One method includes first adhering the major portion of the stencil to the lower surface of the screen, and using the cut closed areas 42 to center areas 45 on the stencil. The closed areas or letters 42 are removed from cover sheet 34, with the center areas 45 being left attached to the cover sheet. The letters 42 are positioned on the upper side of screen 23, aligned with their corresponding stencil aperture, and temporarily held in place by tape, or the like. Center areas 45 are then removed from cover sheet 34, and using the corresponding letter 42 which is visible from the lower side of screen 23, the adhesive side of the center areas 45 are pressed onto lower screen side. The letters 42 are then removed from the upper side of the screen.

Another method for mounting areas 45 on the screen 23 comprises applying a light, hold down adhesive to work surface 40, placing the major portion of the stencil, adhesive side up, on the work surface. The cover sheet on center areas 45 are removed, and the letter centers themselves are centered over the corresponding stencil aperture and pressed onto the work surface to retain the same in place. The lower surface of screen 23 is converged abuttingly against the adhesive side of the fully composed stencil to securely adhere the same to the screen. The stencil is then stripped from working surface 40.

Figure 3:
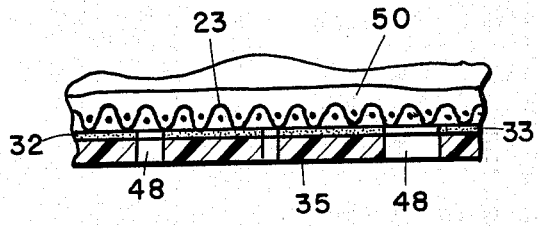
FIG. 3 is a further enlarged, vertical cross-sectional view of the screen, with a stencil adhered thereto.

One end of printing screen 4 is then pivotally attached to the printer by pins 8, and the upper side of the printer is flooded with textile printing ink 50 (FIG. 3). Hold down wax (not shown) is preferably applied to the upper surface of platen 2 to render the same slightly sticky or adhesive, and the article to be printed (not shown) is placed on the upper surface of platen 2, and centered under the stencil. Printing screen 4 is manually pivoted downwardly into abutment with the upper surface of the T-shirt. Downward pressure on screen 4 automatically unlocks latch arm 14. The operator squeegees the upper side of the screen, thereby forcing ink through the apertures of the stencil to print the selected pattern onto the T-shirt. The screen mesh 23 meters the flow of ink through the stencil aperture 48. The operator then refloods the screen, and lifts the printing screen upwardly into the raised, storage position. Latch arm 14 automatically snaps into place to securely retain the screen in the raised position. Squeegee 10 is then tilted against standard 9 to keep it from falling into the ink, and the printed article is removed from platen 11. If required, the ink can be set or cured by the application of a hot iron to the printed design.

The stencil 30 can be easily removed from printing screen 4 by simply peeling the same off of screen mesh 23. In multicolored printing, masking sheet 31 is preferably clear or transparent, and the various patterns are visually registered. Otherwise, metalized plastic is preferred to obtain clear lines of indentation.

The thin, indentable masking sheet with adhesive and cover sheet provide a very uncomplicated and easy means by which even unskilled personnel can form a printing screen which is capable of printing neat, appealing designs. A conventional silk screen is provided above the mask so as to properly meter the flow of ink onto the printed article. The masks or stencils can be easily peeled from the screen to change designs or for printing multicolor patterns.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A method for screen printing with a printer having a platen and a porous screen, the improvement comprising:

providing a sheet of masking, sized to cover said porous screen, and having front and back sides;

positioning said masking, back side up on a work surface;

scribing a selected pattern on the back side of said masking with a pointed instrument, so as to form a corresponding indentation in said masking which is visible from the masking front side; said pattern including at least one closed area;

positioning said masking, front side up on the work surface;

cutting said masking along said indentation;

removing the enclosed areas of said pattern from said masking to form apertures therethrough; and attaching said masking to one side of said screen, whereby during printing, ink is forced through said apertures to print said pattern onto an article.

2. A method as set forth in claim 1, wherein:

said masking back side includes a pressure sensitive adhesive thereon with a cover sheet overlying and adhered to the same;

said scribing is performed on said cover sheet;

said masking attaching step comprising removing said cover sheet, positioning said masking on the work surface, adhesive side up, centering the lower surface of said screen over said masking, and converging said screen into abutment with said masking back side, thereby adhering said masking to said screen.

3. A method as set forth in claim 1, wherein:

said cutting step comprises manually slicing said masking with a knife.

4. In a method for screen printing with a printer having a platen and a porous screen, the improvement comprising:

providing a sheet of masking, sized to cover said porous screen, and including an adhesive coating on a back side thereof with a cover sheet overlying and adhered to the same;

positioning said masking on a work surface cover side up;

scribing a selected pattern on said cover sheet with a pointed instrument so as to form a corresponding indentation in said masking which is visible from the front side of said masking; said pattern including at least one closed area;

positioning said masking front side up on said work surface;

cutting said masking along said indentation;

peeling said cover sheet off of said masking sheet, thereby removing the enclosed areas of said pattern from said masking to form apertures therethrough; and pressing the adhesive side of said masking into abutment with one side of said screen to interconnect the same, whereby during printing, ink is forced through said apertures to print said pattern onto an article.

5. A method as set forth in claim 4, wherein:

said masking attaching step comprises positioning said masking on the work surface, adhesive side up, centering the lower surface of said screen over said masking, and converging said screen into abutment with said one masking side thereby adhering said masking to said screen.

6. A method as set forth in claim 4, wherein:

said masking comprises a metalized plastic.

7. A method as set forth in claim 4, wherein:

said pattern includes alphanumeric symbols; and including laying out said symbols in a readable left-to-right sequence on said cover sheet before said scribing step.

8. A method as set forth in claim 4, wherein:

said masking is transparent; and including providing a second sheet of masking with a second pattern thereon which mates with said first pattern for printing multicolor designs; and visually aligning said first and second patterns.

9. A method as set forth in claim 4, including:

laying out said pattern on said cover sheet with a light marking prior to said scribing step.

10. A method as set forth in claim 4, wherein:
said pattern includes closed areas within said enclosed areas;
said masking attaching step further includes removing said closed areas from said cover sheet and positioning the same on said upper surface of said screen in alignment with the associated masking aperture, and temporarily retaining the same in place, removing said enclosed areas from said cover sheet, and adhering the same to the lower side of the screen by aligning the same within the opening of the mating closed area on the screen upper surface.

11. A method as set forth in claim 4, wherein:
said cutting step comprises manually slicing said masking with a knife.

12. A method as set forth in claim 11, including:
laying out said pattern on said cover sheet with a light marking prior to said scribing step.

13. A method as set forth in claim 11, wherein:
said pattern includes closed areas within said enclosed areas;
said masking attaching step further includes removing said closed areas from said cover sheet and positioning the same on the upper surface of said screen in alignment with the associated masking aperture, and temporarily retaining the same in place, removing said enclosed areas from said cover sheet, and adhering the same to the lower side of said screen by aligning the same within the opening of the mating closed area on the screen upper surface.

14. A method as set forth in claim 13, including:
laying out said pattern on said cover sheet with a light marking prior to said scribing step.

15. A method as set forth in claim 14, wherein:
said masking is a metalized plastic.

16. A method as set forth in claim 15, wherein:
said pattern includes alphanumeric symbols; and including
laying out said symbols in a readable left-to-right sequence on said cover sheet before said scribing step.

17. A method as set forth in claim 16, wherein:
said masking is transparent; and including
providing a second sheet of masking with a second pattern thereon which mates with said first pattern for printing multicolor designs; and visually aligning said first and second patterns for registry.

* * * * *

UNITED STATES PATENT AND TRADEMARK OFFICE

CERTIFICATE OF CORRECTION

PATENT NO. : 4,351,238

DATED : September 28, 1982

INVENTOR(S) : Charles W. Harpold

It is certified that error appears in the above—identified patent and that said Letters Patent is hereby corrected as shown below:

Column 7, Line 6, Claim 10:

"said" before upper should be --the--

Column 7, Line 11, Claim 10:

"the" before screen should be --said--

Signed and Sealed this

*Fifteenth* Day of *February 1983*

[SEAL]

*Attest:*

GERALD J. MOSSINGHOFF

*Attesting Officer*

*Commissioner of Patents and Trademarks*